US005295905A

United States Patent [19]

Simble

[11] Patent Number: 5,295,905

[45] Date of Patent: Mar. 22, 1994

[54] AIR NOZZLE FOR A DIRECTED AIR FLOW INTO A ROOM

[76] Inventor: Per B. Simble, Nadderudveien 33, N-1340 Bekkestua, Norway

[21] Appl. No.: 930,427

[22] PCT Filed: Mar. 21, 1991
[86] PCT No.: PCT/NO91/00045
§ 371 Date: Sep. 16, 1992
§ 102(e) Date: Sep. 16, 1992
[87] PCT Pub. No.: WO91/14904
PCT Pub. Date: Oct. 3, 1991

[30] Foreign Application Priority Data

Mar. 21, 1990 [NO] Norway ..... 901309

[51] Int. Cl.[5] ..... F24F 13/06
[52] U.S. Cl. ..... 454/286; 454/297; 454/305
[58] Field of Search ..... 454/76, 286, 296, 297, 454/305

[56] References Cited

U.S. PATENT DOCUMENTS

| | | | |
|---|---|---|---|
| 2,056,757 | 10/1936 | Adamcikas | 454/286 |
| 2,189,502 | 2/1940 | Johnston | 454/286 |
| 2,314,850 | 3/1943 | Woelfel . | |
| 2,646,629 | 7/1953 | Clemens | 454/305 X |
| 3,623,420 | 11/1971 | Larkfeldt et al. | 454/305 |
| 3,987,713 | 10/1976 | Larkfeldt et al. | 454/305 |
| 3,988,973 | 11/1976 | Hönmann | 454/286 |
| 4,726,285 | 2/1988 | Kelley | 454/296 X |

FOREIGN PATENT DOCUMENTS

| | | | |
|---|---|---|---|
| 0164738 | 8/1989 | European Pat. Off. | 454/297 |
| 379043 | 8/1932 | United Kingdom | 454/286 |

*Primary Examiner*—Harold Joyce
*Attorney, Agent, or Firm*—Young & Thompson

[57] ABSTRACT

An air nozzle (1) for directed discharge of air into a room (A) and comprising a nozzle head (2) with an air channel (3) being adjustably provided in a mounting opening (4) in a surface (5), e.g., the wall of a compressed air channel or a compressed air chamber. Nozzle head (2) is provided to be rotatable in mounting opening (4) and with its axis of rotation (B) normal to the plane of mounting opening (4). The air channel (3) extends from its inlet opening (3*a*) to its outlet opening (3*b*) with a decreasing cross sectional area (C), at least along its first longitudinal portion (3'). The air channel shows a change of direction in order to provide an approximately laminar discharge flow of air at an angle ($\alpha$), preferably in the range of 10°–45°, with the plane of mounting opening (4).

4 Claims, 3 Drawing Sheets

AIR NOZZLE FOR A DIRECTED AIR FLOW INTO A ROOM

Figure 1:
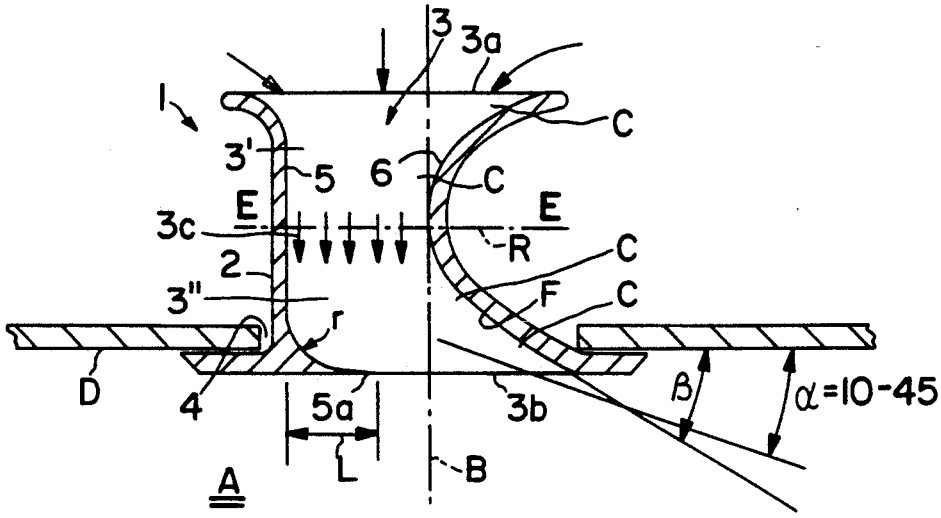

The present invention relates to an air nozzle for a directed air flow into a room.

Ventilation of rooms, like offices, residences, and the like must be characterized as problematic in a historical view and it is burdened with problems of poor air exchange, overheating/undercooling as well as poor induction and noise and draught.

Demands for an improved indoors/working environment now involve more strict requirements of ventilation, and there is thus a demand for improved product concepts.

This is the background of the present invention which relates to an air nozzle for supply of ventilation air to rooms.

A distributor comprising an air nozzle/air nozzles is often placed in a room at the end of a channel and is crucial to the air of the room as regards draught, cold down blast, noise, and the like. The existing kinds of distributors show poor induction and their application is, thus, limited. Distributors in ceilings, thus, commonly comprise a perforated disk, through which air flows into the room, whereas wall and channel valves are constructed from adjustable lamellae. When the direction of the air is to be adjusted with such distributors, this is done by adjusting the angle of lamellae, which will at the same time cause a change of loss of pressure and of the noise level across the distributor. Distributors with perforated disks are often provided with guide bars behind the perforated plate. In this case the pressure and noise levels will be changed by adjustment of the direction of the air when guide bars are adjusted.

It is an object of the present invention to provide a distributor or an air nozzle, by the aid of which it is possible to adjust the direction of the air flow and the distributor pattern of air distribution without any influence on the loss of pressure and noise level.

According to the present invention this is achieved by the features appearing from the characterizing part of the following independent claim 1 as well as from the following dependent claims.

According to the invention an air nozzle of the above mentioned kind is, thus, achieved with the nozzle head being provided to be rotatable in the mounting opening and with its rotational axis normal to the plane of the mounting opening. The air channel extends with a cross sectional area which is reduced from the channel inlet to its outlet, at least along its first longitudinal section, and the air channel is curved to cause a change of direction to achieve a substantially laminar air flow at an acute angle to the plane of the mounting opening. This means that when the air nozzle is mounted in a ceiling, air will flow from the air nozzle in a downward direction and at an acute angle with the surface of the ceiling. The nozzle head being provided to be rotatable in the mounting opening, the air flow may be adjusted within 360° with said acute angle being preserved relative to the plane of the mounting opening.

By mounting a number of such air nozzles at a mutual distance in a ceiling surface, air jets from the nozzle heads of the distributors may be adjusted relative to each other, so that the air jets may be made to flow in the same or opposite directions or across each other to achieve desired admixture of the air jets with the air of the room and, thus, to determine the distribution of air with high and/or low temperature in the room and to prevent cold down blasts and draught.

The invention will be disclosed in more detail below with reference to the drawing, which shows diagrammatical views of the air nozzle according to the invention and various arrangements of the same as well as mutual adjustment of nozzle heads in order to achieve desired patterns of air flows.

Figure 2:
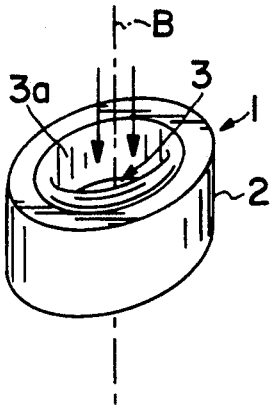
Figure 3:
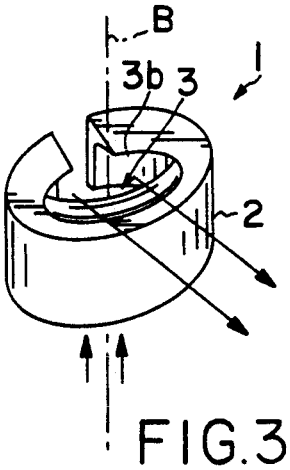
Figure 4:
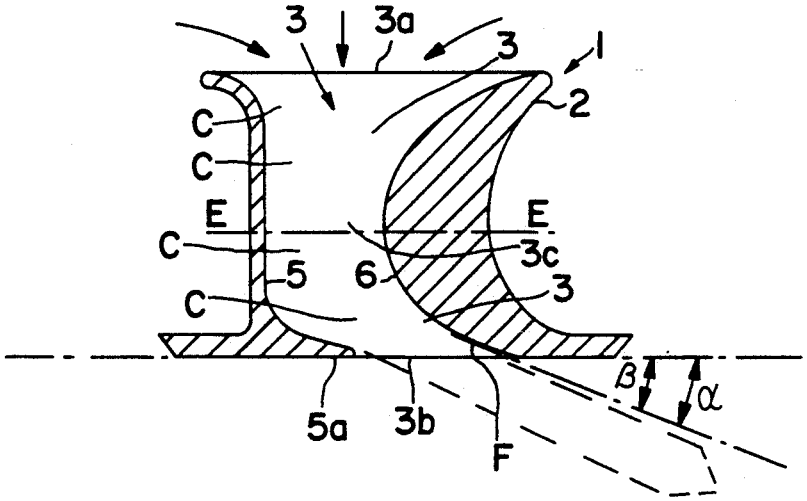
Figure 5:
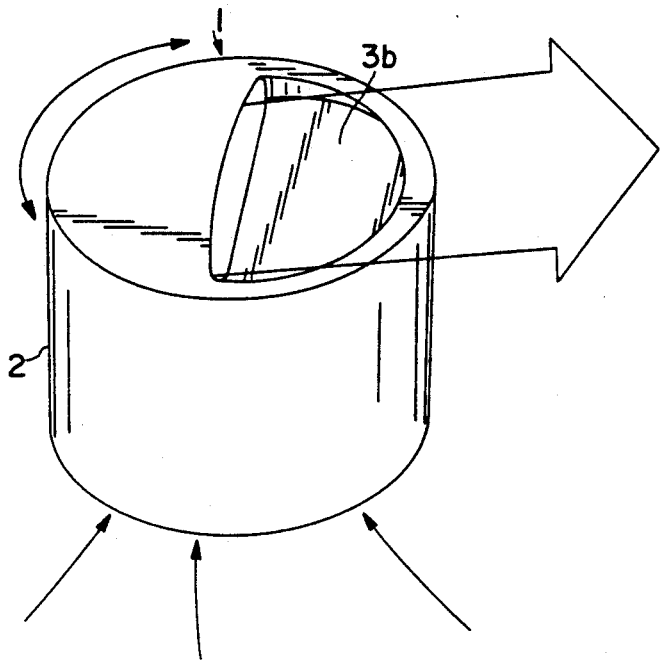
Figure 6A:
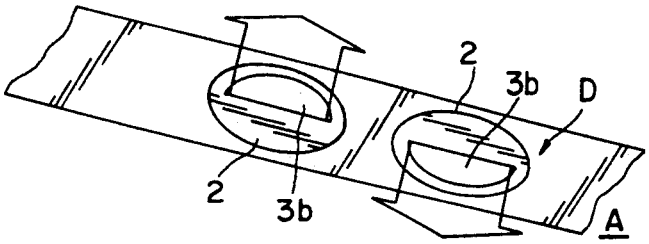
Figure 7:
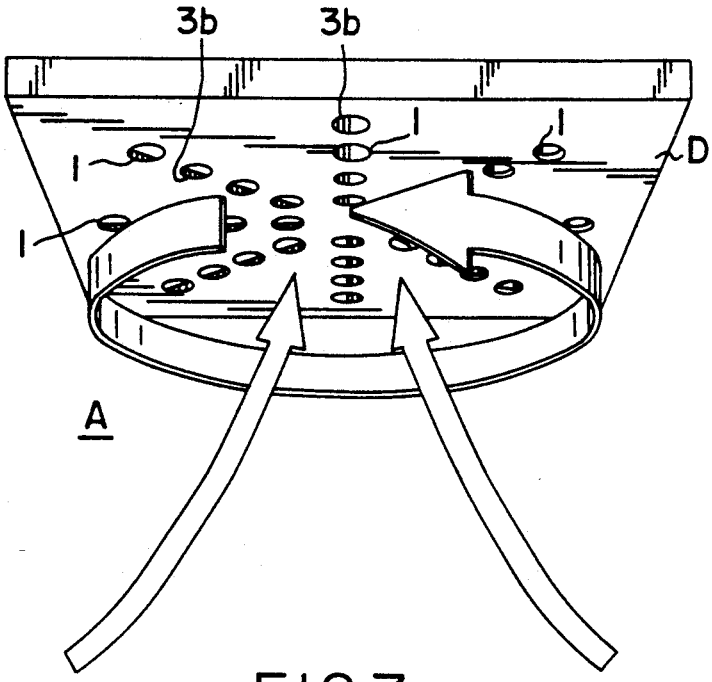
Figure 8:
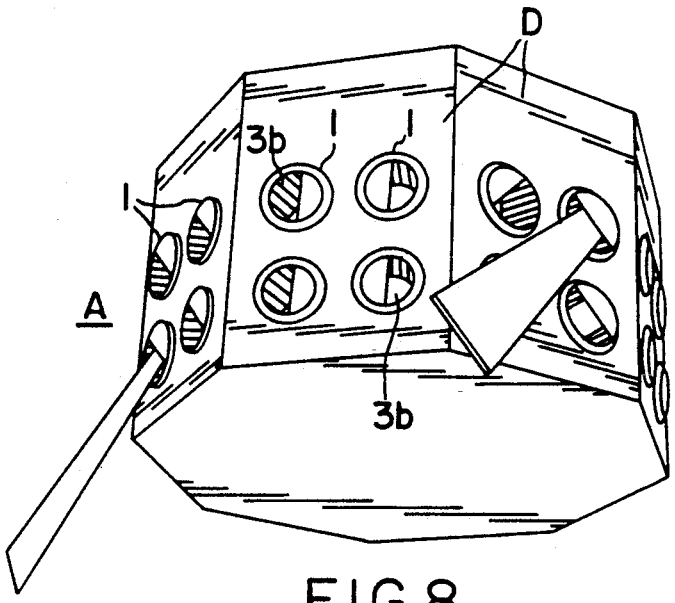

FIG. 1 is a sectional view of an air nozzle which is mounted in a ceiling surface towards a room, FIGS. 2 and 3 are perspective views of the air nozzle, as seen from its inlet, and outlet, respectively, FIG. 4 is a sectional view of the air nozzle, as shown in FIG. 1, but with an arrow indicating air flow, FIG. 5 shows the air nozzle in perspective and as seen towards its outlet with an arrow indicating air flow, FIGS. 6*a, b, c* show air nozzles which are mounted at a mutual distance in a surface and with the nozzle head of the air nozzles adjusted in various manners to achieve different patterns of air flow, and FIGS. 7 and 8 are perspective views of two different kinds of air supply distributors with air nozzles according to the invention mounted in said distributors.

FIG. 1 shows a longitudinal section of an air nozzle 1 comprising a nozzle head 2 with an air channel 3, which nozzle is provided to be rotatable in a mounting opening 4 in a surface D, e.g. the wall surface of a compressed air channel or a compressed air chamber or in the ceiling surface of a room with said compressed air chamber or channel provided behind the ceiling surface. Nozzle head 2 is, as mentioned, provided to be rotatable in mounting opening 4 and with an axis of rotation B normal to the plane of mounting opening 4. Air channel 3 extends from its inlet 3*a* to its outlet 3*b* with a decreasing cross sectional area C along its first longitudinal portion 3'. The air channel shows a change of direction E—E in its are between first longitudinal portion 3' and second longitudinal portion 3''. Second longitudinal portion 3'' may, e.g. be designed with a constant cross sectional area C along its entire length for achievement of an approximately laminar air flow at an angle $\alpha$, preferably in the range of 10°–45° relative to the plane of mounting opening 4. Said approximately laminar air flow from outlet 3*b* of second longitudinal portion 3'' may also be achieved in other manners which will be discussed below.

In an embodiment of nozzle head 2, which is partly shown in FIGS. 1 and 2 and 4, the first longitudinal portion 3' has the shape of a truncated, eccentric funnel with an approximately circular inlet opening 3*a* and with an elongated/oval transition opening 3*c* to the second longitudinal portion 3'' with outlet 3*b* also being elongated/oval. This transition opening 3*c* is situated in the area of change of direction E—E of the air channel 3.

The opposed wall surfaces of air channel 3, as seen in section normal to the plane of curvature of the air channel, form the outer and inner guide faces 5, 6 of the air channel. Inner guide face 6 is curved from inlet 3*a*, past the area of change of direction E—E where, as shown in FIG. 1, it continues forming a tangential portion F to one longitudinal side of the elongated/oval outlet 3*b*. Outer guide face D takes a substantially straight course in parallel with axis of rotation B of nozzle head 2, but it has an outwards curved portion at inlet 3*a* and an inwards curved portion in the shape of a lip 5*a* at outlet 3*b*. The radius of curvature r of lip 5*a* and the radius of curvature R of inner guide face 6 in the area of change of direction E—E, and angle $\beta$ between tangential portion F and the plane of mounting opening 4 contribute to determine the laminar shape of the air flow and its angular direction, as shown in FIGS. 1 and 4.

It will appear from FIG. 1 that the radius of curvature r of outer guide face at lip 5*a* is smaller than the radius of curvature R of the inner guide face 6.

From FIG. 1 it will also appear that the air is guided evenly from all sides into inlet 3*a* of nozzle head 2 and is concentrated in the first longitudinal portion 3' of air channel 3 and made unidirectional in the area of change of direction E—E, in which the air flow will have an approximately axial direction in the longitudinal direction of nozzle head 2. In the second longitudinal portion 3" of the air channel said axial air flow is deflected and influenced by said guide faces 5, 6 and their curvatures to provide a discharge of air in a laminar shape and with the desired angular direction $\alpha$ relative to the plane of mounting opening 4. By changing the radius of curvature r of lip 5*a* as well and the length L of said lip and, furthermore by changing radius R of inner guide face 6, the angle of discharge $\alpha$ of the air flow may be adjusted, preferably within 10°–45° relative to the plane of mounting opening 4.

In a practical embodiment of air nozzle 1 nozzle head 2 has a circular cylindrical external shape with parallel end faces in which inlet and outlet openings 3*a*, 3*b* are provided. By providing optional fastening lips/beads on the cylindrical portion of nozzle head 2, and with complementary means in mounting opening 4, nozzle head 2 may be snapped in place and stay freely rotatable. Such fastening means may obviously be designed in many different manners. Nozzle head 2 and mounting opening 4 may, e.g. be provided with cooperating snap/retaining means for step-wise rotation and adjustment of the nozzle head 2 and, consequently, the direction of the air flow.

Figure 6B:
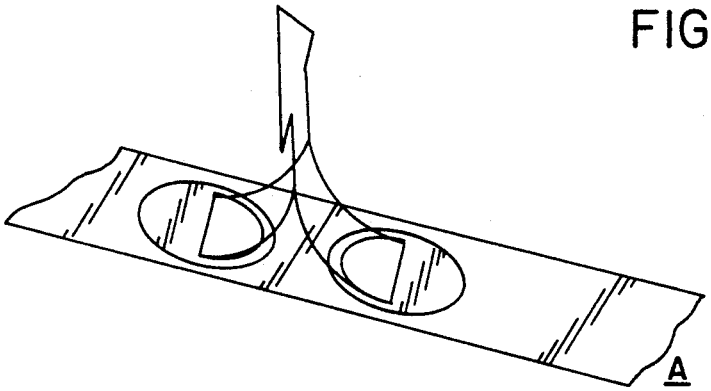
Figure 6C:
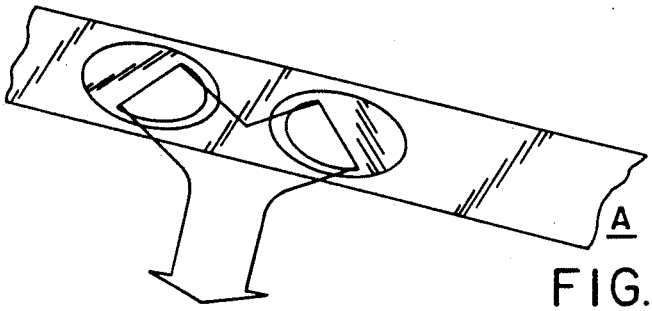

As shown in FIG. 6 a plurality of nozzle heads 2 may be provided in a mutually spaced manner in mounting openings 4 in a surface D, e.g. along a ceiling surface in a room A. By mutual adjustment of nozzle heads 2 relative to each other the air jets may be arranged to flow in opposite directions and mutually displaced, as shown in FIG. 6*a*, or mutually opposed so as to collide and deflect each other, as shown in FIG. 6*b*, or so as to flow in mutually declined directions to join into a deflected air flow, as shown in FIG. 6*c*. The air nozzle, i.e. nozzle heads 2, may thus be rotated about their axes of rotation B without this influencing pressure loss and/or noise level. Even when two or more air nozzles 1 are set with their air jets directed straight at each other pressure loss or noise level will not change. It was, thus, possible to provide a distributor with a plurality of air nozzles 1, in which the total air flow maybe set to a desired pattern of dissipation without this changing the perimenters of pressure loss and noise level of the distributor.

By the aid of the above mentioned retaining means for stepwise rotation and adjustment of nozzle head 2, and with a predetermined angle of rotation between each step, e.g. 15°, the nozzle heads 2 may be turned into desired positions in a graduation system in which the exact angle of nozzle heads 2 relative to zero positions may be determined by counting the number of "clicks" during rotation. This will be helpful for adjustment of the separate nozzle heads 2 if a certain pattern of distribution is desired and recorded. It will then be possible to try various settings of nozzles heads 2 and then to return to those mutual settings of nozzle heads 2 which are found to be most suitable for providing the desired pattern of distribution.

FIGS. 7 and 8 show two perspective views of two different distributors with air nozzles 1, the nozzle heads of which are arranged in openings 4 in the external peripheries D of the distributors. FIG. 7 thus shows a horizontal surface D facing down and comprising air nozzles 1, and FIG. 8 shows a distributor with vertical surfaces D which together define an octagonal chamber with a bottom closing downwards and with the air nozzles 1 being provided in the vertical surfaces D of the chamber.

The air nozzle according to the present invention proved to have a much higher degree of induction (i.e. the capability of the air beam for entraining ambient air) than the above mentioned perforated valves and lamella valves.

The air flow is divided into many small air jets which are individually adjustable by the aid of said air nozzles 1 with rotatable nozzle heads. The air jets flowing out show an approximately oval cross section corresponding to the shape of outlet opening 3*b* in order to provide the largest possible surface as compared with an air jet of a circular cross section.

Tests also very surprisingly proved that two or more air jets may be directed towards each other without this producing noise or increasing the loss of pressure. The air nozzles will be excellently suited for distribution of low and/or high temperature air to a room A because the high degree of induction of the provided air jets will counteract cold down blasts and draught.

I claim:

1. In an air nozzle (1) for directed discharge of air into a room (A) and comprising a nozzle head (2) with an air channel (3) which is adjustably provided in a mounting opening (4) in a solid surface (D), which nozzle head (2) is rotatably provided in said mounting opening (4) with its axis of rotation (B) normal to the plane of said mounting opening (4), and with said air channel (3) extending from its inlet opening (3*a*) to its outlet opening (3*b*) with a decreasing cross sectional area (C) at least in the first longitudinal portion (3') of said air channel (3), with a change of direction in order to provide air discharge at an acute angle ($\alpha$) with the plane of mounting opening (4); the improvement wherein said first longitudinal portion (3') of air channel (3) has the shape of a truncated eccentric funnel with an approximately circular inlet opening (3*a*) and with an elongated transition opening (3*c*) to a second longitudinal portion (3") having an elongated outlet opening (3*b*), which transition opening (3*c*) is situated between said first and second longitudinal portions (3', 3") in a region (E—E) for said change of direction of said air channel (3), two opposite wall faces of said air channel (3), as seen in section in the plane of change of direction of the air channel, forming two guide faces (5, 6), of which the first guide face (6) is curved, with the outer side of the curve facing the air channel, from said inlet opening (3*a*) past the region (E—E) for said change of direction, where said outer side of the curve continues as a tangential portion (F) to one longitudinal side of the elongated outlet opening (3*b*), and where the second guide face (5) extends substantially straight in parallel with the nozzle head axis of rotation (B) and with an outwards curved portion at said inlet opening (3*a*) and with an inwards curved portion in the shape of a lip (5*a*) at said outlet opening (3*b*), the radius of curvature (r) of said lip (5*a*) and the radius of curvature (R) of said first guide face (6) and the angle ($\beta$) between said tangential portion (F) and the plane of said mounting opening (4) determining the laminar shape and the angular direction ($\alpha$) of the discharged air flow.

2. An air nozzle according to claim 1 wherein the radius of curvature (r) of the second guide face (5) at said lip (5*a*) is smaller than the radius of curvature (R) of the first guide face (6).

3. An air nozzle according to claim 1, wherein said nozzle head (2) has a circular cylindrical outer shape with parallel end faces in which the inlet and outlet openings (3*a*, 3*b*) are provided.

4. An air nozzle according to claim 1, wherein said nozzle head (2) and mounting opening (4) are provided with cooperating retention means for step-wise rotation and setting of said nozzle head (2) and, thus, the direction of the air flow.

* * * * *